US005260694A

United States Patent [19]

Remahl

[11] Patent Number: 5,260,694

[45] Date of Patent: Nov. 9, 1993

[54] AUTOMATIC ARTICLE TRACKING SYSTEM FOR MANUALLY OPERATED DELIVERY SYSTEM

[75] Inventor: Bertil Remahl, Charlotte, N.C.

[73] Assignee: NDC Automation, Inc., Charlotte, N.C.

[21] Appl. No.: 819,465

[22] Filed: Jan. 10, 1992

[51] Int. Cl.[5] ..... G08B 21/00; G08B 13/24

[52] U.S. Cl. ..... 340/674; 340/568; 340/572; 340/988; 340/825.32; 364/478

[58] Field of Search ..... 340/674, 673, 568, 572, 340/991, 989, 988, 825.32, 825.35, 825.37; 364/478, 424.01, 403

[56] References Cited

U.S. PATENT DOCUMENTS

| | | | |
|---|---|---|---|
| 3,815,084 | 6/1974 | Pease | 340/988 |
| 4,673,932 | 6/1987 | Ekchian et al. | 340/825.54 |
| 4,786,229 | 11/1988 | Henderson | 414/786 |
| 4,796,209 | 1/1989 | Burk | 364/559 |
| 4,827,395 | 5/1989 | Anders et al. | 364/138 |
| 5,006,996 | 4/1991 | Nakamura et al. | 364/478 |
| 5,113,349 | 5/1992 | Nakamura et al. | 364/478 |

*Primary Examiner*—Glen R. Swann, III

*Attorney, Agent, or Firm*—W. Thad Adams, III

[57] ABSTRACT

An article tracking system includes a delivery zone transmitter associated with at least one physical article delivery location for transmitting data identifying that physical location, a zone detector carried by at least one manually operated article delivery vehicle for detecting the physical proximity of the vehicle to the delivery zone, and a signal device operatively associated with the zone detector for outputting a signal indicating the physical proximity of the vehicle to the delivery zone. Therefore, an operator of the vehicle is informed that the vehicle is in the proper delivery zone for delivery of an article.

20 Claims, 5 Drawing Sheets

AUTOMATIC ARTICLE TRACKING SYSTEM FOR MANUALLY OPERATED DELIVERY SYSTEM

TECHNICAL FIELD AND BACKGROUND OF THE INVENTION

This invention relates to an automatic article tracking system for a manually operated article delivery system. The system is particularly adapted for use in a manufacturing or industrial environment where articles, such as assembly parts, raw materials, and finished goods are moved through a manufacturing, storage or distribution facility.

Most article storage and transport tracking still takes place manually in the sense that responsibility for actual movement of the articles resides with a particular individual or individuals. Goods are moved through a system based on the perception and skill of the operator, who must follow instructions to deliver an article from one point to another. While the article may be identified by a bar code or similar identification, there is no control over the correctness of the delivery of the article from one point to another.

Misdelivery of an article to, for example, an assembly point or to a loading dock can decrease efficiency and increase costs. An article incorrectly placed on the wrong loading dock and onto the wrong truck can take days or weeks, if ever, to correct.

It has been noted that such mistakes, if inadvertent, tend to occur more frequently near the end of a work shift, when the vehicle operator is tired, bored, or in a hurry to complete assigned projects before the end of the work day.

This type of system is also susceptible to pilferage and thievery, since an employee can easily and deliberately misdirect articles away from their intended delivery point.

On the other extreme, some systems now are completely automated and can pick articles from a pick-up location, identify the article, deliver the article to a delivery point under computer control and adjust the inventory of articles accordingly. This system is ideal for some applications but is relatively expensive and not suitable for many applications.

This application relates to an article tracking system in which the articles are moved about as required manually by an operator using, for example, a forklift. Nevertheless, the articles are identified and delivered while the vehicle is monitored to insure that the articles move to the intended point by the intended operator. If the articles are not delivered as required, the vehicle operator or a supervisor can correct the situation immediately. The system operates automatically and completely without the requirement that the vehicle operator input any location data. All the vehicle operator need do is respond to the instructions relayed by a host computer to a display terminal on the vehicle.

SUMMARY OF THE INVENTION

Therefore, it is an object of the invention to provide an article delivery system which permits articles to be delivered manually under monitoring to insure that the articles are delivered as required.

It is another object of the invention to provide an article delivery system which permits the identity and proper location of an article to be automatically conveyed to a vehicle operator for manual delivery according to the instructions.

It is another object of the invention to provide an article delivery system which includes the identification of zones where articles are to be picked up and delivered.

It is another object of the invention to provide an article delivery system which includes alarm means for identifying when an article has not been delivered as required.

These and other objects of the present invention are achieved in the preferred embodiments disclosed below by providing an article tracking system, comprising delivery zone transmitting means associated with at least one physical article delivery location for transmitting data identifying that physical location, zone detecting means carried by at least one manually operated article delivery vehicle for detecting the physical proximity of the vehicle to the delivery zone, and signal means operatively associated with the zone detecting means for outputting a signal indicating the physical proximity of the vehicle to the delivery zone. Therefore, an operator of the vehicle is informed that the vehicle is in the proper delivery zone for delivery of the article.

According to one preferred embodiment of the invention, the system includes computing means, and the signal means includes signal relay means for relaying from the computing means to the vehicle the identity of the delivery zone where the article is to be delivered and for relaying from the vehicle to the computing means the signal indicating the physical proximity of the vehicle to the delivery zone.

According to another preferred embodiment of the invention, the invention includes an article pick-up zone transmitting means associated with at least one physical article pick-up location for transmitting data identifying that physical location.

Preferably, the delivery zone transmitting means comprises a passive radio frequency transmitter and the delivery zone detecting means comprises a radio frequency interrogator/detector for generating a detection signal for the delivery zone transmitting means to transmit in response thereto.

Preferably, the pick-up zone transmitting means comprises a passive radio frequency transmitter and the zone detecting means comprises a radio frequency interrogator/detector for generating a detection signal for the pick-up zone transmitting means to transmit in response thereto.

According to one preferred embodiment of the invention, the system includes article identification means for identifying an article and associating the identity of the article with the at least on article delivery location.

According to another preferred embodiment of the invention, the computing means includes alarm means for sending an alarm signal to the vehicle if the vehicle enters an improper delivery zone and an alarm on the vehicle for generating an alarm to the vehicle operator.

According to yet another preferred embodiment of the invention, the article identification means associates the identity of the article with the at least one article pick-up location.

According to yet another preferred embodiment of the invention, the delivery zone transmitting means and the pick-up zone transmitting means are applied to a floor on which the vehicle operates.

According to yet another preferred embodiment of the invention, the delivery zone transmitting means and pick-up zone transmitting means are applied to a ceiling below which the vehicle operates.

According to yet another preferred embodiment of the invention, the passive radio frequency transmitter comprises an identification tag carrying data representing a particular physical location and an antenna operatively connected to the identification tag for encompassing the physical location represented by the identification tag.

According to another preferred embodiment of the invention, display means on the vehicle are provided for displaying physical location information to the vehicle operator in order for the vehicle operator to confirm that the article has been taken to the correct physical location associated with that particular article.

According to yet another preferred embodiment of the invention, central display means are associated with the computing means for permitting supervisory personnel to monitor the location of vehicles and thereby determine that articles carried by the vehicle have been delivered to the correct location.

An embodiment of the method for tracking the delivery of articles according to the invention comprises the steps of identifying at least one physical delivery zone, associating delivery zone transmitting means with the delivery zone for transmitting data identifying that physical location, and providing a vehicle having delivery zone detecting means for detecting the physical proximity of the vehicle to the delivery zone. Signal means are operatively associated with the zone detecting means. A signal is output indicating the physical proximity of the vehicle to the delivery zone, whereby an operator of the vehicle is informed that the vehicle is in the proper delivery zone for delivery of the article.

According to another preferred embodiment of the invention, the method includes the steps of providing computing means, providing signal relay means, relaying from the computing means to the vehicle the identity of the delivery zone where the article is to be delivered, and relaying from the vehicle to the computing means the signal indicating the physical proximity of the vehicle to the delivery zone.

According to another preferred embodiment of the invention, the method includes the step of providing an article pick-up zone transmitting means associated with at least one physical article pick-up location for transmitting data identifying that physical location.

According to another preferred embodiment of the invention, the method includes the step of transmitting means comprises a passive radio frequency transmitter. The delivery zone detecting means comprises a radio frequency interrogator/detector for generating a detection signal for the delivery zone transmitting means to transmit in response thereto.

According to another preferred embodiment of the invention, the pick-up zone transmitting means comprises a passive radio frequency transmitter and the zone detecting means comprises a radio frequency interrogator/detector for generating a detection signal for the pick-up zone transmitting means to transmit in response thereto.

According to another preferred embodiment of the invention, the method includes the steps of providing article identification means for identifying an article and associating the identity of the article with the at least one article delivery location.

According to another preferred embodiment of the invention, the computing means includes alarm means for sending an alarm signal to the vehicle if the vehicle enters an improper delivery zone and an alarm on the vehicle for generating an alarm to the vehicle operator.

According to another preferred embodiment of the invention, the method includes the step of associating the identity of the article with at least one article pick-up location.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
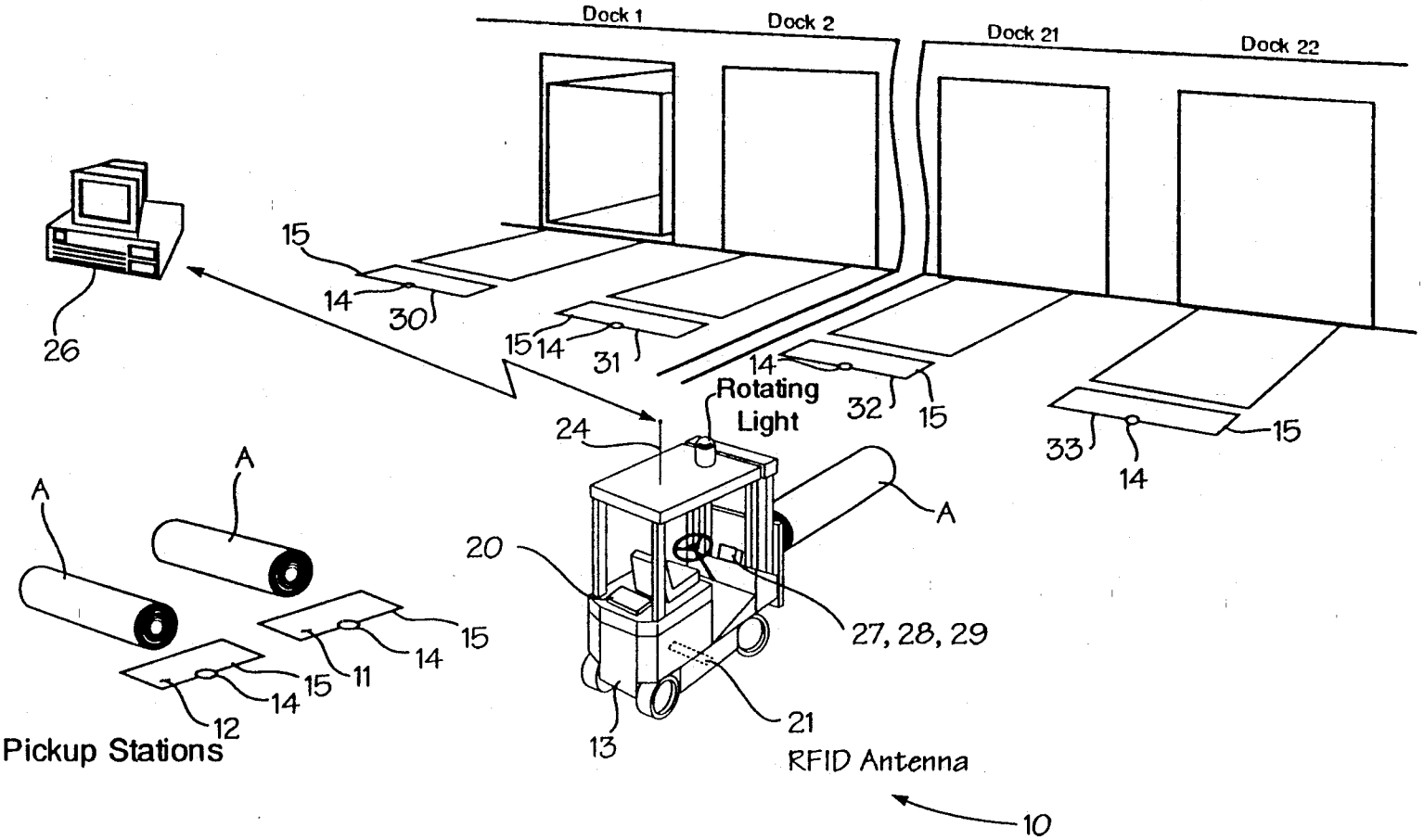
FIG. 1 is a schematic perspective view of an article tracking system according to an embodiment of the invention.

Referring now specifically to the drawings, a article tracking system according to the present invention is illustrated in FIG. 1 and shown generally at reference numeral 10. In the system shown in FIG. 1, pick-up zones 11 and 12 are defined as physical article pick-up locations to which a vehicle 13, such as a forklift, goes to pick-up an article "A" such as a roll of carpet.

Figure 4:
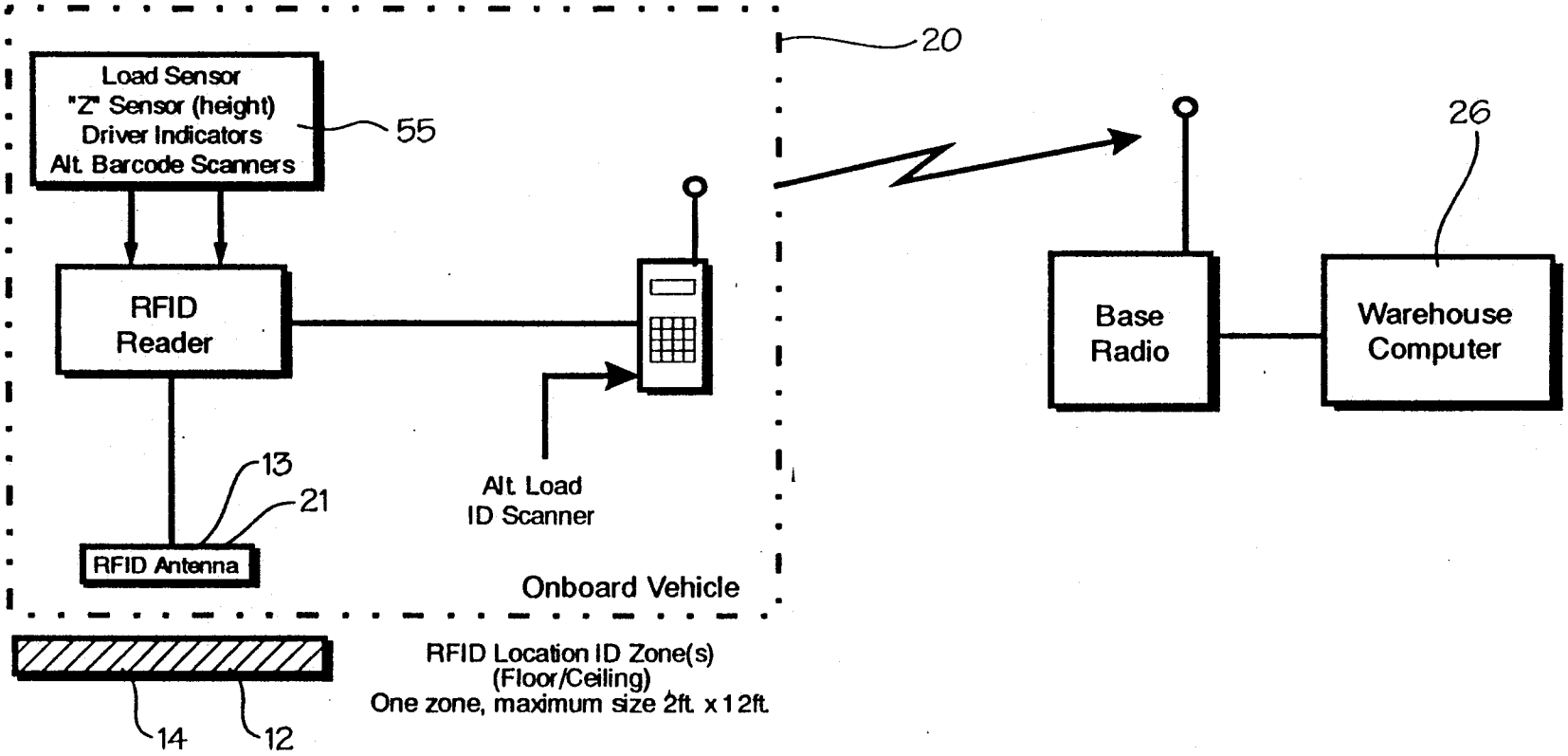
FIG. 4 is a schematic view of a radio frequency zone detecting and article identifying apparatus according to an embodiment of the invention.

Each of the zones 11 and 12 are identified electronically by a passive transducer 14 which is enclosed in a durable plastic case which is embedded in the floor. The transducer 14 has an electrically erasable read-only memory (EEROM) circuit. A reception coil and suitable circuitry in the transducer 14 permit a zone detecting means, such as a radio frequency reader circuit 20 and reader antenna 21 carried by the vehicle 13 to supply energy by induction to the transducer 14. See FIG. 4. Circuitry in the transducer 14 reacts by transmitting a unique, programmed signal which is detected by the read portion of the circuit 20. Each transducer 14 is inductively connected to an antenna 15. The antenna 15 forms a loop which define the zones 11 and 12. The respective transducers 14 which are connected to the antennas 15 of the zones 11 and 12 are programmed to respond to the reader antenna 21 with a signal which identifies that zone.

The transducers 14 may be any suitable transducer performing the described functions. The ones preferably used are NDC Magic Point(TM) Labels manufactured by Nedap NV of Groenlo, Holland and marketed in North America by applicant.

The reader circuit 20 is preferably a Nedap GIS reader, also manufactured by Nedap NV and marketed in North America by applicant. The reader antenna 21 is also manufactured by Nedap NV.

The vehicle is also equipped with signal relay means such as an antenna 24 which relays information from the vehicle to a host computer 26, a buzzer 27, display terminal 28 and a signal lamp 29. The functions of these elements are described below.

Still referring to FIG. 1, other transducers 14 are positioned to define physical article delivery zones 30, 31, 32 and 33. Antennas 15 form loops which define the zones 30–33 and operate as described above.

Figure 2:
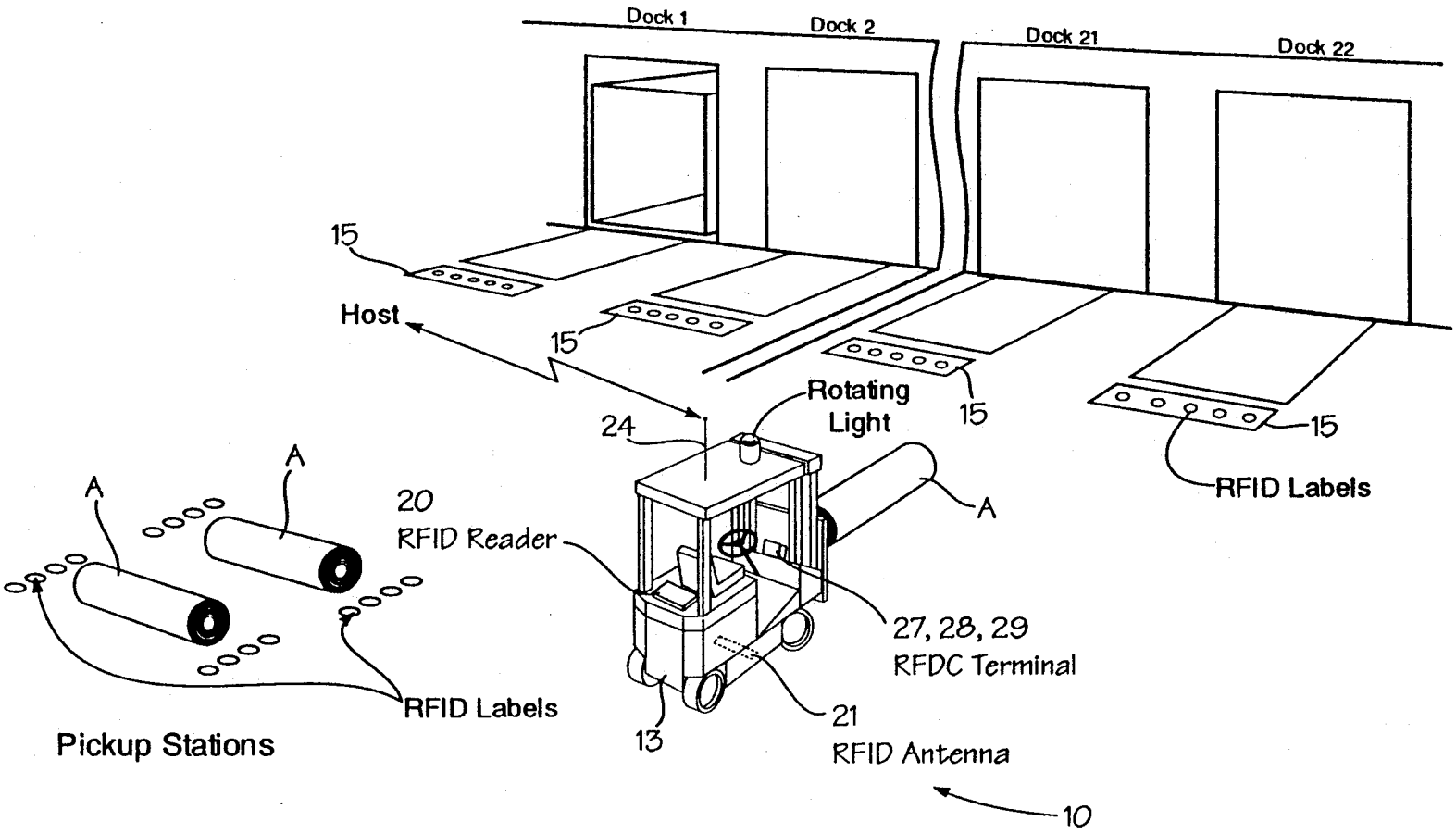
FIG. 2 is a schematic perspective view of an article tracking system according to an alternative embodiment of the invention.

An alternative embodiment of the invention to that disclosed above is shown in FIG. 2. Elements in common with FIG. 1 are identified with prime notation. The major difference resides in the use of a plurality of transducers 14 to define each of the zones 11' and 12' without the use of an antenna 15. Otherwise the system functions the same as the system in FIG. 1.

Figure 3:
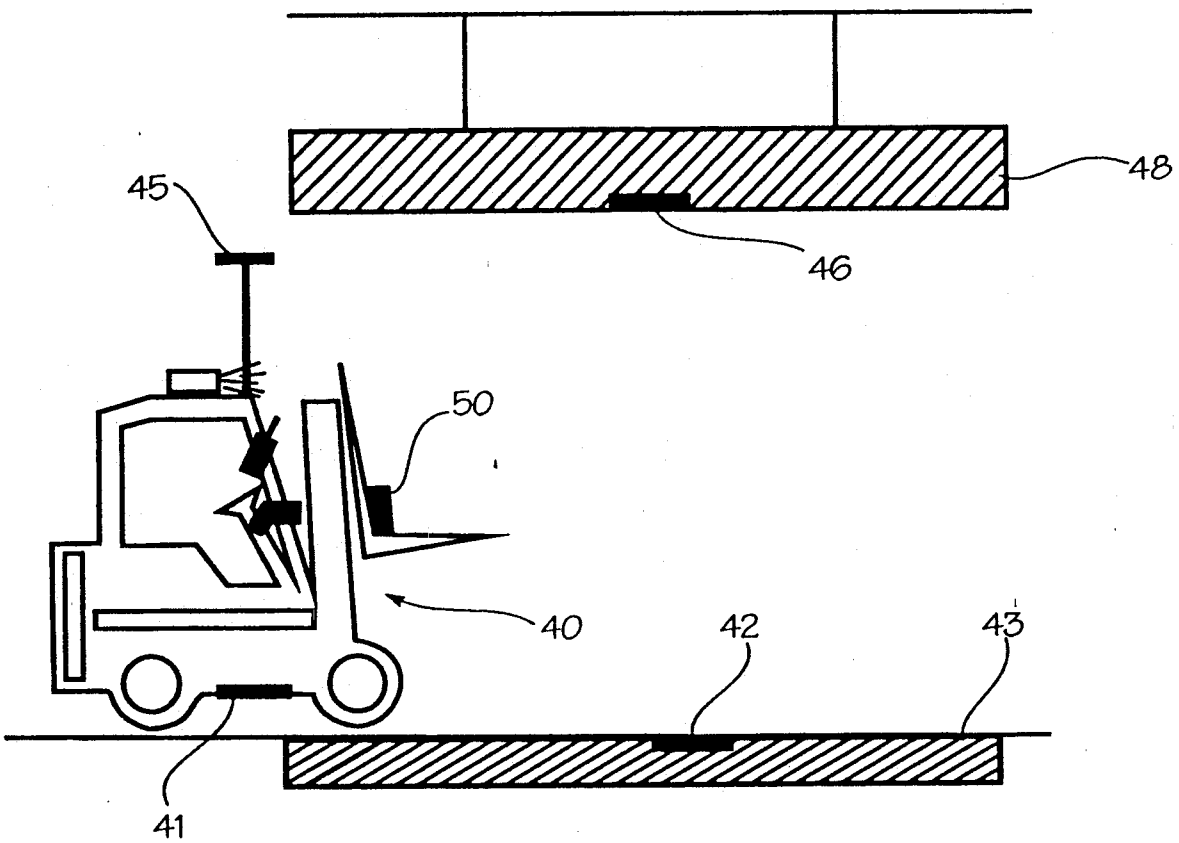
FIG. 3 is a schematic view of a vehicle equipped according to the invention, showing its features and relationship to identification zones in the floor and/or ceiling.

Referring now to FIG. 3, a schematic view of a further variation is shown. In FIG. 3, the pick-up and delivery zones may be either embedded in the floor, or suspended from the ceiling or a combination of both. When utilizing a system with both floor and ceiling zones, a vehicle 40 would include a reader antenna 41 suspended on the bottom of the vehicle 40 for reading data sent from a transducer 42 defining a floor zone 43, and a reader antenna 45 mounted on the top of the vehicle for reading data sent from a transducer 46 mounted in the ceiling and defines a ceiling zone 48.

The vehicle 40 in FIG. 3 also includes a radio frequency antenna 50 which ca be used to identify and distinguish individual articles as they are loaded. In such a case a transducer 14 would be mounted on the article or on a container or pallet in or on which the article is contained. A bar code reader could also be used, in which case the articles would be marked or tagged with bar code labels.

In FIG. 1 articles such as carpet rolls are delivered to a pick-up zone 11 or 12. The pick-up zones 11 or 12 are defined as described above.

As an example of a typical sequence, at pick-up zone 11 or 12, vehicle 13 picks up an article to be delivered, such as a roll of carpet. The signal received by the antenna 21 from the antenna 15 is sent to the host computer 26 which, in accordance with pre-loaded data, transmits to terminal 28 on vehicle 13 a code representing the proper delivery zone to which the carpet must be delivered. This code is translated into a location, such as a loading dock number. The operator of the vehicle 13 sees this location on terminal 28 and manually drives the vehicle 13 to the delivery zone of that location, i.e., one of the delivery zones 30–33.

If the operator in fact arrives at the correct delivery zone, the reader 20 reads the signal sensed by the antenna 21 and delivered to the reader 20. The host computer 26 verifies that the correct signal has been received and that the vehicle has arrived at the correct delivery zone. A signal light or some other indicator on the terminal 28 informs the operator that the article has been delivered to the correct delivery zone.

If the operator arrives at an incorrect delivery zone, the computer 26 detects that the signal sensed by the antenna 21 and delivered to the reader 20 is incorrect and does not match the correct delivery zone. A signal light or some other indicator on the terminal 28 informs the operator that the article has been delivered to the incorrect delivery zone. Depending on the particular requirements of a facility, a supervisor may be required to turn off the signal light or otherwise take steps to insure that the article is taken to the correct delivery zone. After unloading the article at the correct delivery zone, the host computer 26 is informed that the vehicle 13 has left the delivery zone to which the article was delivered. If an incorrect delivery address occurs, the computer 26 will not give the next pick-up and delivery assignment to the vehicle operator until appropriate action is taken to correct the situation. Then the above steps are repeated.

A load sensor 55 (see FIG. 4) senses when a load is picked up, and when a load is unloaded, and changes state. Zones passed by the vehicle 13 on the way from the pick-up zone to the delivery zone and read by reader 20 are not transmitted to host computer 26 because the load sensor 55 blocks transmission of the sensed location signals unless a change in load status is sensed by the load sensor 55.

Of course, if in a given situation it is necessary or desireable for the host computer 26 to know that the vehicle is in a particular intermediate location, the reader 20 can be programmed to permit intermediate locations to be transmitted to the host computer 26. This would be desireable when, for example, certain areas of a facility are off-limits to employees, etc.

The load sensor 55 operates by sensing the height of the fork of the fork lift vehicle 13 as it moves. For this reason, the height of the load and hence the position of the articles above ground level can easily be determined. If desired, the proper location of articles to be identified in three dimensions, since the location of the article can not only be determined by reference to the pick-up and delivery zones, but also its position on, for example, a storage rack, shelf or pallet.

Figure 5:
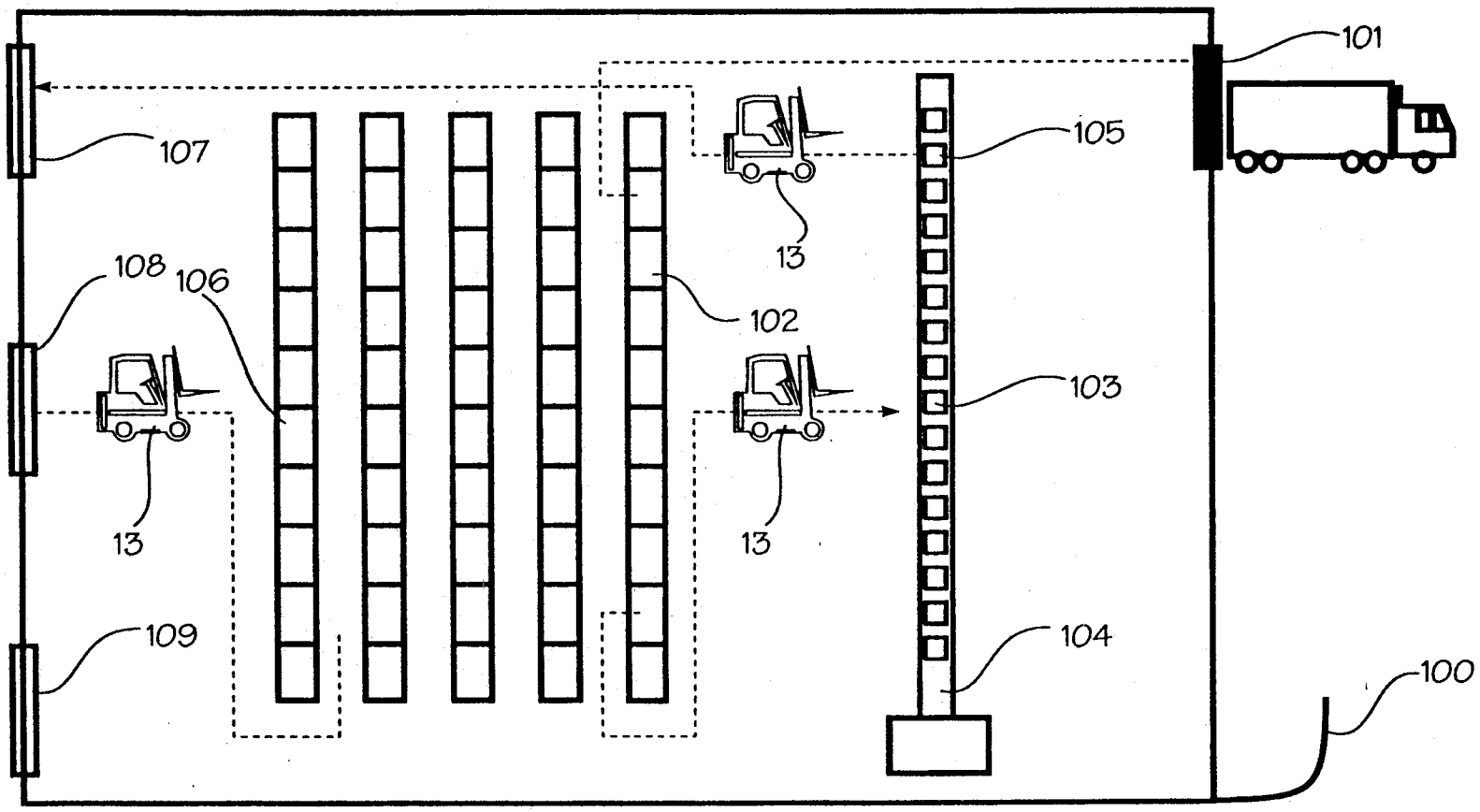
FIG. 5 is an overall plan view of a hypothetical manufacturing and distribution facility operating in accordance with system of and according to a method of the invention disclosed in this application.

An overall plan view of a hypothetical manufacturing and distribution facility 100 operating in accordance with system of and according to a method of the invention disclosed in this application is illustrated in FIG. 5. Using the system identified above, articles can be delivered to a delivery dock 101 which is defined as a delivery zone 101. The articles may be tagged with a transducer or with a bar code label so that the article may be tracked through the facility 100.

In FIG. 5, the articles are taken to a storage area 102 which is defined as a delivery zone 102. Later, the articles may be picked up as described above, in which case the same storage area is defined as a pick-up zone 102. The articles are taken to a particular location 103, defined as a delivery zone 103, of an assembly line 104.

Downstream of the delivery zone 103 a location 105 is defined as a pick-up zone 105. The vehicle picks up the articles at pick-up zone 105, and may be directed to a finished goods storage location 106, defined as a delivery zone 106, or the articles may be taken directly to one of several loading docks, defined as delivery zones 107, 108, 109. All of these steps take place as described above, and may or may not involve identification of particular articles. The delivery and pick-up zones may be imbedded in the floor, suspended from the ceiling or a combination of both.

Of course, this system can be used in combination with a conventional system wherein the vehicle operator is responsible a specified times for keying in location and/or article identification data.

As noted above, all of the actual movement of the articles is manually carried out by vehicle operators. The system insures that the articles are delivered where they are supposed to be delivered.

A article tracking system for a manually operated article delivery system is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. An article tracking system, comprising:

(a) delivery zone transmitting means associated with at least one physical article delivery location for transmitting data identifying that physical location;

(b) zone detecting means carried by at least one manually operated article delivery vehicle for automatically detecting the physical proximity of the vehicle to the delivery zone without vehicle operator activity; and (c) signal means operatively associated with said zone detecting means for outputting a signal indicating the physical proximity of the vehicle to the delivery zone;

whereby an operator of the vehicle is informed that the vehicle is in the proper delivery zone for delivery of the article.

2. An article tracking system according to claim 1, and including an article pick-up zone transmitting means associated with at least one physical article pick-up location for transmitting data identifying that physical location.

3. An article tracking system according to claim 2, wherein said pick-up zone transmitting means comprises a passive radio frequency transmitter and said zone detecting means comprises a radio frequency interrogator/detector for generating a detection signal for the pick-up zone transmitting means to transmit in response thereto.

4. An article tracking system according to claim 1, wherein said delivery zone transmitting means comprises a passive radio frequency transmitter and said delivery zone detecting means comprises a radio frequency interrogator/detector for generating a detection signal for the delivery zone transmitting means to transmit in response thereto.

5. An article tracking system according to claim 3 or 4, wherein said delivery zone transmitting means and said pick-up zone transmitting means are applied to a floor on which the vehicle operates.

6. An article tracking system according to claim 3 or 4, wherein said delivery zone transmitting means and pick-up zone transmitting means are applied to a ceiling below which the vehicle operates.

7. An article tracking system according to claim 3 or 4, wherein said passive radio frequency transmitter comprises an identification tag carrying data representing a particular physical location and an antenna operatively connected to said identification tag for defining the physical location represented by said identification tag.

8. An article tracking system according to claim 1, and including display means on said vehicle for displaying physical location information to the vehicle operator in order for the vehicle operator to confirm that the article has been taken to the correct physical location associated with that particular article.

9. An article tracking system according to claim 1, and including central display means associated with said computing means for permitting supervisory personnel to monitor the location of vehicles and thereby determine that articles carried by the vehicle have been delivered to the correct location.

10. An article tracking system comprising:

(a) delivery zone transmitting means associated with at least one physical article delivery location for transmitting data identifying that physical location;

(b) zone detecting means carried by at least one manually operated article delivery vehicle for detecting the physical proximity of the vehicle to the delivery zone; and (c) signal means operatively associated with said zone detecting means for outputting a signal indicating the physical proximity of the vehicle to the delivery zone;

(d) article identification means for identifying an article and associating the identity of the article with said at least one article delivery location, wherein said article identification means associates the identity of the article with at least one article pick-up location;

whereby an operator of the vehicle is informed that the vehicle is in the proper delivery zone for delivery of the article.

11. An article tracking system according to claim 10, and including computing means, wherein said signal means includes signal relay means for relaying from said computing means to said vehicle the identity of the delivery zone where the article is to be delivered, and for relaying from the vehicle to the computing means the signal indicating the physical proximity of the vehicle to the delivery zone.

12. An article tracking system according to claim 11, wherein said computing means includes alarm means for sending an alarm signal to the vehicle if the vehicle enters an improper delivery zone and an alarm on said vehicle for generating an alarm to the vehicle operator.

13. A method for tracking the delivery of articles within an article pick-up and delivery area, comprising the steps of:

(a) identifying at least one physical delivery zone;

(b) associating delivery zone transmitting means with said delivery zone for transmitting data identifying that physical location;

(c) providing a vehicle having delivery zone detecting means for automatically detecting the physical proximity of the vehicle to the delivery zone without vehicle operator activity;

(d) providing signal means operatively associated with said zone detecting means; and (e) outputting a signal indicating the physical proximity of the vehicle to the delivery zone;

whereby an operator of the vehicle is informed that the vehicle is in the proper delivery zone for delivery of the article 14. A method according to claim 13, and including the steps of:

(a) providing computing means;

(b) providing signal relay means;

(c) relaying from said computing means to said vehicle the identity of the delivery zone where the article is to be delivered; and (d) relaying from the vehicle to the computing means the signal indicating the physical proximity of the vehicle to the delivery zone.

15. A method according to claim 13 or 14, and including the steps of:

(a) providing physical identification means for identifying an article; and (b) associating the identity of the article with said at least one article delivery location.

16. A method according to claim 15, and including the step of associating the identity of the article with at least one article pick-up location.

17. A method according to claim 14, wherein said computing means includes alarm means for sending an alarm signal to the vehicle if the vehicle enters an improper delivery zone and an alarm on said vehicle for generating an alarm to the vehicle operator.

18. A method according to claim 13, and including the step of:

(a) providing an article pick-up zone transmitting means associated with at least one physical article pick-up location for transmitting data identifying that physical location.

19. A method according to claim 18, wherein said pick-up zone transmitting means comprises a passive radio frequency transmitter and a zone detecting means comprises a radio frequency interrogator/detector for generating a detection signal for the pick-up zone transmitting means to transmit in response thereto.

20. A method according to claim 13, wherein said delivery zone transmitting means comprises a passive radio frequency transmitter and said delivery zone detecting means comprises a radio frequency interrogator/detector for generating a detection signal for the delivery zone transmitting means to transmit in response thereto.

* * * * *